US006805173B2

(12) United States Patent
Healy

(10) Patent No.: US 6,805,173 B2
(45) Date of Patent: Oct. 19, 2004

(54) VAPOR SPACE PRESSURE CONTROL SYSTEM FOR UNDERGROUND GASOLINE STORAGE TANK

(75) Inventor: James W. Healy, Hollis, NH (US)

(73) Assignee: Healy Systems, Inc., Hudson, NH (US)

( * ) Notice: Subject to any disclaimer, the term of this patent is extended or adjusted under 35 U.S.C. 154(b) by 0 days.

(21) Appl. No.: 10/453,191

(22) Filed: Jun. 2, 2003

(65) Prior Publication Data

US 2003/0192620 A1 Oct. 16, 2003

Related U.S. Application Data

(63) Continuation-in-part of application No. 10/340,951, filed on Jan. 13, 2003.

(60) Provisional application No. 60/428,018, filed on Nov. 21, 2002, provisional application No. 60/408,949, filed on Sep. 5, 2002, provisional application No. 60/387,458, filed on Jun. 10, 2002, provisional application No. 60/364,745, filed on Mar. 15, 2002, and provisional application No. 60/347,698, filed on Jan. 11, 2002.

(51) Int. Cl.[7] ..... B65B 1/04

(52) U.S. Cl. ..... 141/59; 141/286

(58) Field of Search ..... 141/98, 82, 59, 141/392, 286; 55/524, 527

(56) References Cited

U.S. PATENT DOCUMENTS 4,057,085 A * 11/1977 Shihabi ..... 141/59
4,131,141 A 12/1978 Weissenbach
4,223,706 A * 9/1980 McGahey ..... 141/59
5,305,807 A 4/1994 Healy
5,537,911 A 7/1996 Ohlrogge et al.
5,803,136 A 9/1998 Hartsell, Jr.
5,878,790 A * 3/1999 Janssen ..... 141/59
6,128,908 A 10/2000 Gustafson
6,478,849 B1 11/2002 Taylor et al.

FOREIGN PATENT DOCUMENTS

| | | |
|---|---|---|
| DE | 196 06 181 | 8/1997 |
| DE | 198 29 805 | 2/2000 |
| EP | 0 514 993 | 11/1992 |
| EP | 0 985 634 | 3/2000 |

OTHER PUBLICATIONS

International Search Report; PCT/US03/18069; Sep. 18, 2003; C. Muller.

International Search Report; PCT/US03/00906; M. Desittere; May 13, 2003.

* cited by examiner

*Primary Examiner*—Steven O. Douglas
(74) *Attorney, Agent, or Firm*—Fish & Richardson P.C.

(57) ABSTRACT

A passive pressure control method and system for controlling pressure in the ullage vapor space of a volatile liquid fuel underground storage tank ("UST") temporarily, during periods of increasing ullage vapor space pressure, allows vapor to flow into an auxiliary vapor space of variable volume, defined at least in part by a resilient wall member, thereby to reduce the volume of vapor otherwise released to the environment.

27 Claims, 3 Drawing Sheets

VAPOR SPACE PRESSURE CONTROL SYSTEM FOR UNDERGROUND GASOLINE STORAGE TANK

This application is a continuation-in-part of U.S. application Ser. No. 10/340,951, filed Jan. 13, 2003, now pending, which claims benefit of U.S. Provisional Application No. 60/347,698, filed Jan. 11, 2002, and U.S. Provisional Application No. 60/364,745, filed Mar. 15, 2002, both now abandoned. This application also claims benefit of U.S. Provisional Application No. 60/387,458, filed Jun. 10, 2002, now abandoned, U.S. Provisional Application No. 60/408,949, filed Sep. 5, 2002, and U.S. Provisional Application No. 60/428,018, filed Nov. 21, 2002. The complete disclosures of all of the applications listed above are incorporated herein by reference.

TECHNICAL FIELD

This invention relates to underground gasoline storage tanks, and more particularly to systems for controlling escape of gasoline vapor from such tanks.

BACKGROUND

During refueling of automobiles and other vehicles, liquid gasoline is delivered into the vehicle fuel tank, and a mixture of gasoline (or other fuel) vapor and air is displaced from the tank. To minimize escape of gasoline vapor into the atmosphere, gasoline dispenser nozzles are typically equipped (as often mandated by local environmental protection regulations) with vapor recovery vacuum systems to collect the displaced gasoline vapor, and air, and deliver it back into the ullage (i.e., vapor) space of the underground storage tank ("UST"). Preferably, a 1-to-1 ratio balance is sought between volume of liquid gasoline drawn from the underground storage tank, e.g. during vehicle refueling, to volume of gasoline vapor and air returned into the ullage space by the vapor recovery system. However, due to a variety of factors, including, e.g., differences in temperature, inefficiencies in the vapor recovery system, ingestion of excessive external air, etc., such a balance is difficult to achieve. As a result, some amount of gasoline vapor may be discharged, or air ingested, through the UST pressure/vacuum relief vent valve during any 24-hour period of operation.

This problem has been addressed, in part, by design of ORVR ("onboard refueling vapor recovery") equipped vehicles, in which gasoline vapor collecting in the ullage space of the vehicle tank is recovered onboard the vehicle, making it necessary for the fuel dispensing system to recover only a relatively smaller volume of gasoline vapor and air during refueling, e.g. as compared to non-ORVR vehicles. As a result of the differences between ORVR-equipped and non-ORVR-equipped vehicles, and the fact that both types of vehicles are in regular use, fuel dispensing systems must be designed to detect and accommodate different vapor recovery requirements.

One such fuel dispensing system employs the Healy 800 Nozzle, from Healy Systems, Inc., of Hudson, N.H., assignee of the present application, which is embodied in my earlier U.S. Pat. No. 6,095,204, issued Aug. 1, 2000, the complete disclosure of which is incorporated herein by reference. However, during ongoing field-testing of the Healy 800 Nozzle for purposes of addressing a need to prevent return of too much air when refueling ORVR-equipped vehicles, a troubling phenomenon has been uncovered. A feature of the Healy 800 Nozzle is that it reduces the volume of air returned to the underground storage tank to approximately 25% of the liquid volume dispensed to an ORVR-equipped vehicle. It has been discovered that this can create a problem in a busy service station because ORVR refueling can cause the vapor space pressure to fall to −8.0 inches W.C. ("water column"), at which point the UST pressure/vacuum relief vent valve will open, thus introducing air into the UST. For example, calculations show that less than 600 gallons of gasoline dispensed to ORVR-equipped vehicles can reduce the UST pressure by +8.0 inches W.C. when the ullage space is 20,000 gallons. Additional fueling of ORVR-equipped vehicles beyond that point will then result in a one-to-one relationship of air returned to the UST versus liquid gasoline dispensed, as the Healy 800 Nozzle will continue to return air at a 25% rate while the pressure/vacuum relief vent valve will continue to reopen to allow inward air flow equal to 75% of the liquid gasoline dispensed. Later, when sales activity slows down in the evening and refueling of ORVR-equipped vehicles drops off, the large quantity of air previously ingested will promote evaporation of liquid gasoline into the air in the ullage space, as the enclosed system of gas and liquid moves toward an equilibrium of hydrocarbon concentration in the ullage space with the volume of liquid gasoline. The increasing concentration of gasoline vapor will cause the pressure in the UST to rise, potentially to a positive pressure of +3.0 inches W.C., which will cause the pressure/vacuum relief vent valve to reopen, releasing gasoline vapor into the environment. The problem is not apparent for service stations pumping an average of less than about 150,000 gallons per month; however, it can be very pronounced for larger sites, e.g. those that pump an average over about 500,000 gallons per month.

SUMMARY

According to one aspect of the invention, a passive pressure control method for controlling pressure in ullage vapor space of a volatile liquid fuel underground storage tank ("UST") comprises the steps of: removing liquid fuel from the UST, including for delivery into a vehicle fuel tank, delivering into the ullage vapor space of the UST, to replace the volume of liquid fuel removed, a gaseous flow comprising at least one of: (a) fuel vapor and air, e.g. displaced from the fuel tank by delivery of the liquid fuel; and (b) air; and, during periods of increasing ullage vapor space pressure, allowing vapor to flow into an auxiliary vapor space of variable volume defined at least in part by a resilient wall member, the flow of vapor into the auxiliary vapor space causing deflection of the resilient wall member, thereby increasing the combined vapor storage volume of the ullage vapor space and the auxiliary vapor space.

Preferred embodiments of this aspect of the invention may include one or more of the following additional features. The passive pressure control method comprises the further step of, during periods of decreasing ullage vapor space pressure, causing vapor to flow from the auxiliary vapor space under pressure of deflection of the resilient wall member. The passive pressure control method comprises the further step of treating the gaseous flow into the ullage vapor space to increase the concentration of fuel vapor in the gaseous flow, including toward saturation.

According to another aspect of the invention, a passive pressure control system for controlling pressure in the ullage vapor space of a volatile liquid fuel underground storage tank ("UST") comprises means for temporarily, during periods of increasing ullage vapor space pressure, allowing vapor to flow into an auxiliary vapor space of variable volume, defined at least in part by a resilient wall member.

Preferred embodiments of this aspect of the invention may include one or more of the following additional features. The passive pressure control system further comprises means for temporarily, during periods of decreasing UST vapor space pressure, causing flow of vapor from the auxiliary vapor space into the ullage vapor space. The passive pressure control system further comprises means for treating a gaseous flow into the ullage vapor space in a manner to increase the fuel vapor concentration of the gaseous flow, including toward saturation.

According to still another aspect of the invention, a passive pressure control system for controlling pressure in the ullage vapor space of a volatile liquid fuel underground storage tank ("UST") comprises an underground storage tank defining a storage volume for storage of volatile liquid fuel with an ullage vapor space, an auxiliary tank defining an auxiliary vapor space in communication with the ullage vapor space, the auxiliary vapor space defined at least in part by a resilient wall member, the resilient wall member being adapted to deflect from an at-rest position in response to increasing vapor pressure in the auxiliary vapor space, thereby to increase the contained effective vapor storage volume of the auxiliary vapor space, and the resilient wall being adapted to return toward the at-rest position in response to decreasing vapor pressure in the auxiliary vapor space, thereby to decrease the contained effective vapor storage volume of the auxiliary vapor space.

Preferred embodiments of this aspect of the invention may include one or more of the following additional features. Deflection of the resilient wall member from the at-rest position in response to increasing pressure in the auxiliary vapor space increases the combined contained effective vapor storage volume of the ullage vapor space and the auxiliary vapor space, allowing vapor to flow from the ullage vapor space into the auxiliary vapor space. Return of the resilient wall member toward the at-rest position in response to decreasing pressure in the auxiliary vapor space decreases the combined contained effective vapor storage volume of the ullage vapor space and the auxiliary vapor space, causing vapor to flow from the auxiliary vapor space toward the ullage vapor space. The passive pressure control system further comprises a pressure relief vent valve in communication with the ullage vapor space and configured to open while pressure of vapor within the ullage vapor space exceeds a predetermined maximum pressure, thereby to permit release of vapor into the environment, wherein deflection of the resilient wall member of the auxiliary vapor space from the at-rest position in response to increasing pressure within the auxiliary vapor space serves to reduce the volume of vapor released to the atmosphere during normal operation. The passive pressure control system further comprises a vacuum pressure relief vent valve in communication with the ullage vapor space and configured to open while pressure of vapor within the ullage vapor space is below a predetermined minimum pressure, thereby to permit ingestion of air into the ullage vapor space, wherein return of the resilient wall member of the auxiliary vapor space toward the at-rest position in response to decreasing pressure within the auxiliary vapor space serves to reduce the volume of air ingested into the vapor space during normal operation. The auxiliary tank comprises a flexible bladder, e.g. a thin wall flexible urethane bladder, defining the resilient wall member. The bladder is disposed within a storage tank, preferably mounted about an inlet defined at an upper end of the storage tank. The auxiliary tank pressure/vacuum relief valve defines an orifice sized to limit flow of air out of the air space external to the bladder (and thus limit flow into the auxiliary vapor space) to a predetermined rate, thereby to restrict the rate of change of the air volume external to the bladder due to pressurization of the ullage vapor space. The relief valve defines an orifice sized to indirectly limit flow of air or vapor into and out of the auxiliary vapor space to a rate of about 2.5 gallons per minute. For use with a balance-type vapor recovery system, the vacuum relief valve is set to near atmospheric pressure and the pressure relief valve is set to near atmospheric pressure.

In preferred embodiments of each of the aspects of the invention described above, the gaseous flow may be treated or conditioned, e.g. by passing it through a liquid fuel mist chamber or through a fuel-wetted mesh, or by causing the gaseous flow to maintain extended flowing contact with liquid-gasoline-wetted surfaces, or by placing the gaseous flow in extended, close proximity or contact with liquid gasoline, e.g. by entraining the gaseous flow with a flow of liquid gasoline and/or by bubbling the gaseous flow through a body of liquid gasoline, e.g. in a liquid reservoir or in the UST itself. Controls may be provided, e.g., to actuate delivery of liquid fuel to the conditioning apparatus when gaseous flow is detected, and/or to ensure that the vacuum/pressure relief valve is not opened for flow of air until a flow of liquid fuel to the conditioning apparatus is confirmed. Effective vapor storage volume may also be increased by removal of vapor from the vapor space, e.g. for treatment.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
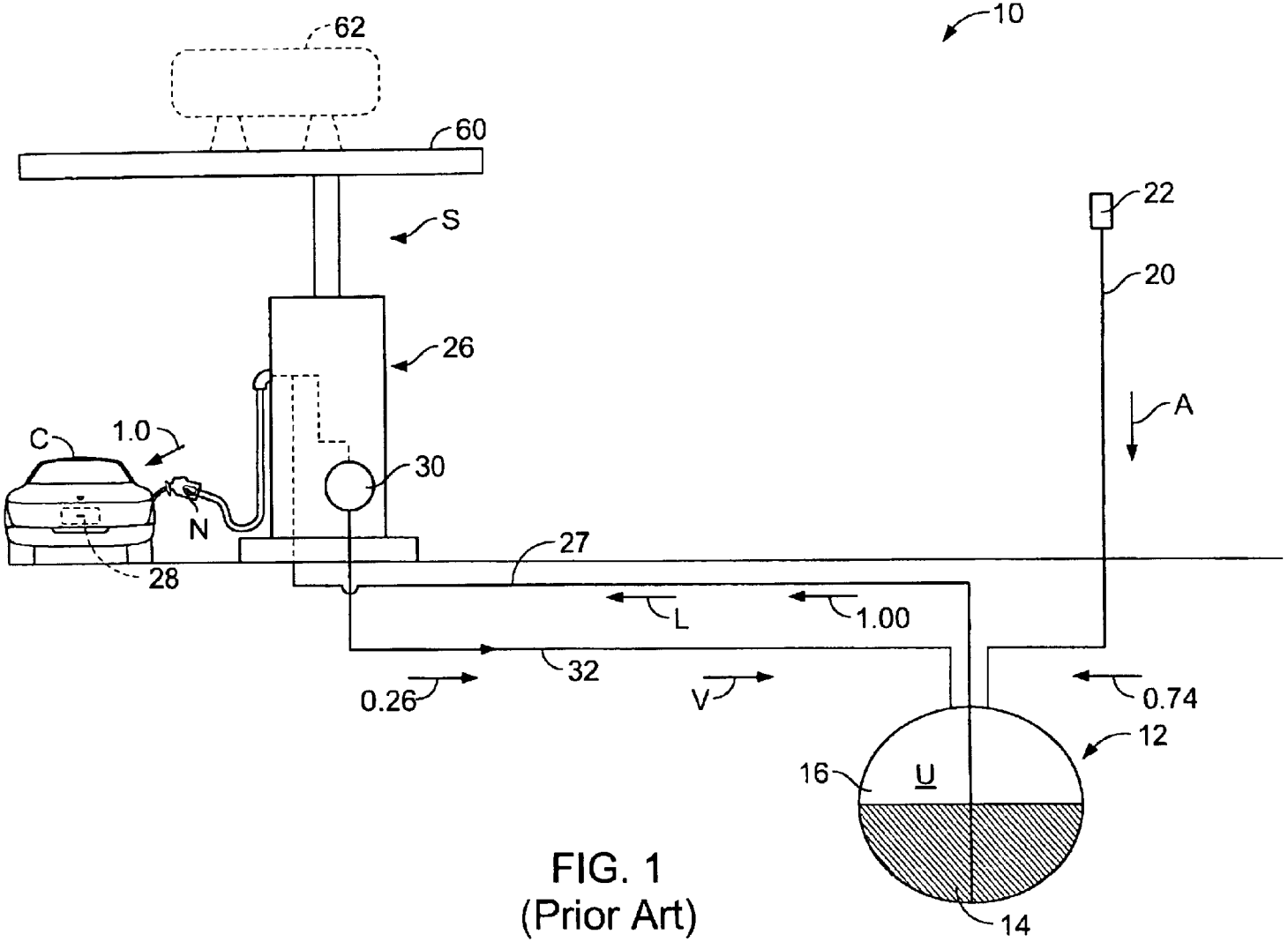
FIG. 1 (Prior Art)
FIG. 1 is a somewhat diagrammatic representation of a typical prior art fuel storage and delivery system.

Referring to FIG. 1, in a typical prior art fuel storage and delivery system 10, e.g. at a gasoline fueling station, S, an underground storage tank ("UST") 12 contains a volume of volatile liquid fuel 14, e.g. gasoline, and a volume of a saturated or semi-saturated mixture of gaseous fuel vapor and/or air 16 in a vapor or ullage space, U, above the liquid fuel. The ullage space is connected to the atmosphere via conduit 20, controlled by a UST pressure/vacuum relief vent valve 22, which typically is set to open at −8.0 inches W.C. to permit intake of air into the ullage space and to open at +3.0 inches W.C. to permit release of gaseous vapor from the ullage space, thereby to avoid dangerous buildup of pressure or vacuum within the UST 12.

During refueling of a vehicle, C, as liquid fuel, L, is delivered via conduit 27 from the UST 12 into the vehicle tank 28, fuel vapor, V, displaced from the vehicle tank by the liquid fuel is recovered (typically in a mixture with air) by vacuum drawn by pump 30 in the fuel dispenser 26 and returned to the ullage space, U, via conduit 32. If the vehicle, C, is an ORVR-equipped vehicle, the vacuum return is set at a relatively lower volume ratio of air ingested to liquid removed for delivery into the vehicle tank, e.g. at a volume ratio of about 0.26 to 1.00 (air to liquid).

Figure 2:
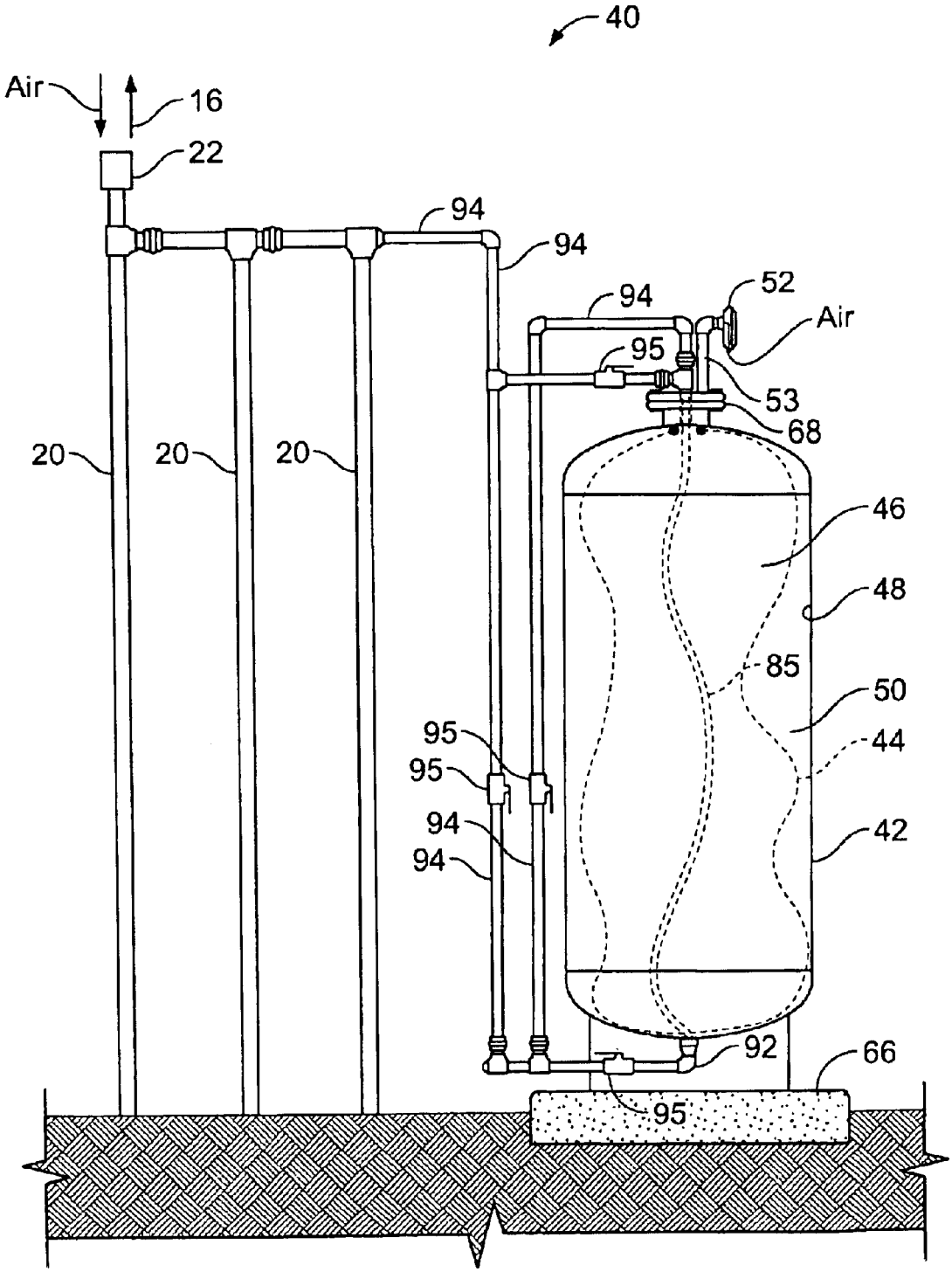
FIG. 2 is a somewhat diagrammatic side section view of a passive pressure control system for temporary storage of vapor from the UST vapor space, e.g., during periods of increased pressure, including a tank containing a bladder.
Figure 3:
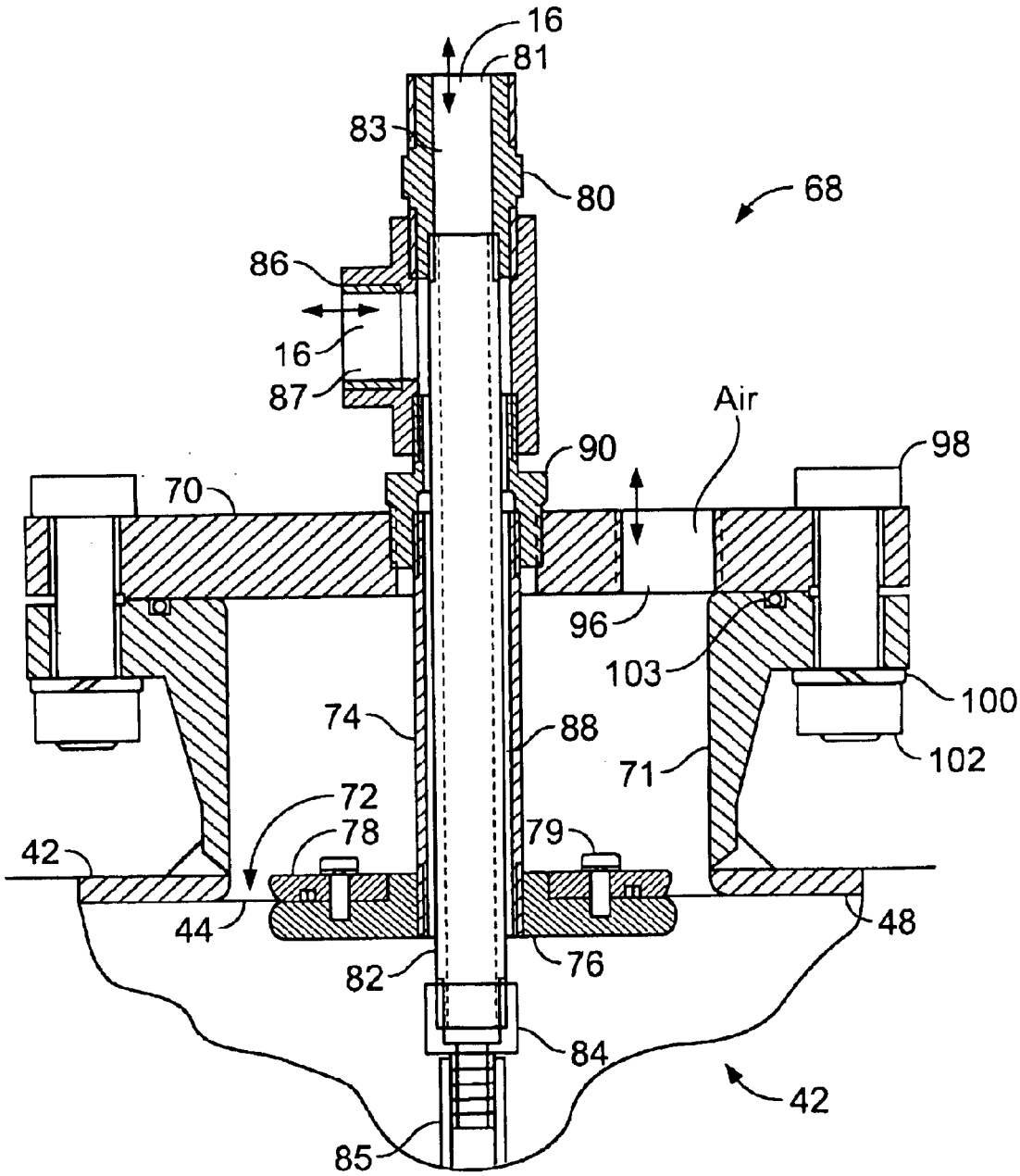
FIG. 3 is a somewhat diagrammatic enlarged side section view of the bladder support assembly for the passive pressure control system of FIG. 2.

Referring now to FIGS. 2 and 3, the phenomena of increasing pressure in the ullage space, U, during off-peak, evening hours, due to the enclosed system of evaporation of liquid gasoline 14 into the ullage space, U, as the system of vapor 16 and liquid 14 moves toward an equilibrium state, is addressed by a passive pressure control system 40. The system includes a storage tank 42, e.g. a 400 gallon steel storage tank, connected to the vent pipe 20, which, in turn, is in communication with the vapor space, U, of a UST 12 (FIG. 1). The vapor space is controlled by the pressure/vacuum relief valve 22 set to open to ingest air into the ullage space, U, in response to vapor space vacuum below −8 inches W.C., and to open to release vapor from the ullage space, U, in response to vapor space pressure over +3 inches W.C. The storage tank 42 contains a thin wall flexible urethane bladder 44 defining an auxiliary vapor space volume 46 in communication with the UST vapor space, U. The flexible bladder 44 and the storage tank wall 48 also together define an air space 50 in communication with the atmosphere through an air relief/air ingestion valve 52 set to open at +¾ inch W.C. to release air from the air space 50 and to open at −¾ inch W.C. to ingest air into the air space 50, as described in more detail below. This is a passive system not requiring electrical components. As a result, installation costs are relatively low.

In FIG. 2, the tank 42 is shown mounted in vertical position upon a concrete tank slab 66 (other suitable methods for installation and mounting may be employed). The flexible bladder 44 is suspended within the air space volume 50 of the tank 42 from the bladder support assembly 68 (FIG. 3). The support assembly includes a flange 70, secured to neck 71 at an aperture 72 into the tank volume by bolts 98 with lock washers 100 and nuts 102, sealed by o-rings 103, from which extends a pipe nipple 74 supporting a circumferential bladder flange 76. A clamp ring 78 bolted (79) to the bladder flange secures and seals the bladder opening. A tap 80 defines an inlet/outlet 81 to a first, axial vapor passageway 83 into the bladder volume 46 by way of pipe nipple 82 terminating in a pipe barb 84 and a siphon tube 85 that extends to the lower end of the bladder 44 within the tank 42. A tee-fitting 86 (to which tap 80 is mounted) defines an inlet/outlet 87 to a second, annular passageway 88 through the space between coupling 90 and pipe nipple 74 and the outer wall of pipe nipple 82. The inlet/outlets 81, 87, as well as condensate drain 92 from the base of the tank air space 50, are connected to vent pipes 20 by 1-inch connection piping 94. Flow through the connection piping 94 is controlled by ball valves 95, which should be padlock-secured against tampering. The air relief/air ingestion valve 52 is connected to a pipe nipple 53 (FIG. 2) mounted to the flange 70 at an aperture 96 in communication with the air space 50 about the bladder 44 in tank 42.

When the service station, S, is actively refueling ORVR-equipped vehicles, C, the Healy 800 Nozzle, N, reduces the volume of air returned to the UST 12 to approximately 25% of the delivered gas volume. This shortfall causes vapor pressure in the UST to go negative. At −¾ inch W.C., the ±¾ inch W.C. air relief/air ingestion valve 52 opens to ingest air into the space 50 between the 400-gallon steel tank 42 and the flexible bladder 44, thus causing the internal volume of the bladder 44 to be transferred into the vapor space, U, of the UST 12. This transfer will continue as long as the −¾ inch W.C. pressure is maintained, and until the bladder 44 is fully collapsed. The vapor space pressure may then continue to drop until reaching −8 inches W.C., at which point the pressure vacuum relief valve 22 will open to allow air to enter the ullage space, U.

When the gasoline service station activity slows down and/or when the station closes for the night, the UST pressure will begin to rise as the system of vapor 16 and liquid gasoline 14 in the ullage space, U, moves toward equilibrium, with liquid gasoline in the UST 12 changing to vapor. At +¾ inch W.C., the air relief/air ingestion valve 52 will open to release air from the space 50 between the wall 48 of the 400-gallon steel tank 42 and the bladder 44, allowing the bladder to expand as it receives vapor 16 from the UST vapor space, U, thus to maintain the UST vapor space pressure at a maximum pressure of +¾ inch W.C. After the flexible bladder 44 is fully expanded, with most or all of the air expelled from the air space 50, the vapor space pressure may continue to rise until reaching +3 inches W.C., at which point the pressure vacuum relief valve 22 will open for release of vapor 16 from the ullage space, U. The storage tank 42 thus provides an additional capacity of 400 gallons for receiving vapor before the relief valve 22 is caused to open.

Also, when a faulty Stage 1 fuel drop occurs, and creates excessive vacuum or pressure in the UST vapor space, the system 40 can also act to limit the growth or exhaustion of auxiliary vapor space capacity in the bladder 44. For example, the air relief valve portion of the air relief/air ingestion valve 52 valve may be provided with an orifice sized to limit flow of vapor (and the excessive volumes of air) into the bladder 44 by restricting flow of air from the tank air space external of the bladder e.g. to a rate of 2.5 gallons per minute, when the UST vapor space pressure, U, is at +3 inches W.C., causing the P/V vent valve 22 to expel relatively large amounts of excess volume and thus preserve available bladder volume for use in reducing the UST vapor space pressure to +¾ inch W.C. when the fuel drop is completed.

A number of embodiments of the invention have been described. Nevertheless, it will be understood that various modifications may be made without departing from the spirit and scope of the invention. For example, the passive pressure control system 40 described above may be used in combination with a gaseous flow conditioning apparatus for treatment of air return/air intake to the ullage space, U, of the UST 12 to increase the degree of saturation of the gaseous flow. Several embodiments of suitable gaseous flow conditioning apparatus are described in my earlier-filed provisional applications (Serial No. 60/347,698, filed Jan. 11, 2002; Serial No. 60/364,745, filed Mar. 15, 2002; and Serial No. 60/387,458, filed Jun. 10, 2002), all as mentioned and incorporated above.

The system 40 may also be employed to control UST vapor space pressure with so-called "balance-type" vapor recovery systems by suitably reducing the air ingestion control portion of the air relief/air ingestion valve 52, e g. from −¾ inch W.C. to near atmospheric pressure, and also suitably reducing the air relief control portion of the air relief/air ingestion valve 52, e.g. from +¾ inch W.C. to near atmospheric pressure. The system 40 may also be employed without control of a functioning air relief/air ingestion valve 52, e.g. in "real world" situations of tank systems 10 having significant air leakage.

The system 40 may also be installed on top of the gasoline service station canopy (60, FIG. 1) using a horizontal tank 62, with the 1-inch vapor space connection (not shown) made to existing vapor return piping 32.

Accordingly, other embodiments are within the scope of the following claims.

What is claimed is:

1. A passive pressure control method for controlling pressure in ullage vapor space of a volatile liquid fuel underground storage tank ("UST") comprising the steps of:

removing liquid fuel from the UST, including for delivery into a vehicle fuel tank, delivering into the ullage vapor space of the UST, to replace the volume of liquid fuel removed, a gaseous flow comprising at least one of:

(a) fuel vapor and air, e.g. displaced from the fuel tank by delivery of the liquid fuel; and (b) air; and, during periods of increasing ullage vapor space pressure, allowing vapor to flow from the ullage vapor space into an auxiliary vapor space of variable volume defined at least in part by a resilient wall member, the flow of vapor into the auxiliary vapor space causing deflection of the resilient wall member, thereby increasing the combined vapor storage volume of the ullage vapor space and the auxiliary vapor space.

2. The passive pressure control method of claim 1, comprising the further step of, during periods of decreasing ullage vapor space pressure causing vapor to flow from the auxiliary vapor space into the ullage vapor space under pressure of deflection of the resilient wall member.

3. The passive pressure control method of claim 1, comprising the further step of treating the gaseous flow into the ullage vapor space to increase the concentration of fuel vapor in the gaseous flow, including toward saturation.

4. A passive pressure control system for controlling pressure in the ullage vapor space of a volatile liquid fuel underground storage tank ("UST") comprising means for temporarily, during periods of increasing ullage vapor space pressure, allowing vapor to flow from the ullage vapor space into an auxiliary vapor space of variable volume, defined at least in part by a resilient wall member.

5. The passive pressure control system of claim 4, further comprising means for temporarily, during periods of decreasing UST vapor space pressure, causing flow of vapor from the auxiliary vapor space into the ullage vapor space.

6. The passive pressure control system of claim 4, further comprising means for treating a gaseous flow into the ullage vapor space in a manner to increase the fuel vapor concentration of the gaseous flow, including toward saturation.

7. A passive pressure control system for controlling pressure in the ullage vapor space of a volatile liquid fuel underground storage tank ("UST") comprising:

an underground storage tank defining a storage volume for storage of volatile liquid fuel with an ullage vapor space, an auxiliary tank defining an auxiliary vapor space in communication with the ullage vapor space, the auxiliary vapor space defined at least in part by a resilient wall member, said resilient wall member adapted to deflect from an at-rest position in response to increasing vapor pressure in the auxiliary vapor space, thereby to increase the contained effective vapor storage volume of the auxiliary vapor space, and said resilient wall adapted to return toward the at-rest position in response to decreasing vapor pressure in the auxiliary vapor space, thereby to decrease the contained effective vapor storage volume of the auxiliary vapor space.

8. The passive pressure control system of claim 7, wherein deflection of the resilient wall member from the at-rest position in response to increasing pressure in the auxiliary vapor space increases the combined contained effective vapor storage volume of the ullage vapor space and the auxiliary vapor space, allowing vapor to flow from the ullage vapor space into the auxiliary vapor space.

9. The passive pressure control system of claim 7 or claim 8, wherein return of the resilient wall member toward the at-rest position in response to decreasing pressure in the auxiliary vapor space decreases the combined contained effective vapor storage volume of the ullage vapor space and the auxiliary vapor space, causing vapor to flow from the auxiliary vapor space toward the ullage vapor space.

10. The passive pressure control system of claim 7, further comprising a pressure relief vent valve in communication with the ullage vapor space and configured to open while pressure of vapor within the ullage vapor space exceeds a predetermined maximum pressure, thereby to permit release of vapor into the environment, wherein deflection of the resilient wall member of the auxiliary vapor space from the at-rest position in response to increasing pressure within the auxiliary vapor space serves to reduce the volume of vapor released to the atmosphere during normal operation.

11. The passive pressure control system of claim 7 or claim 10, further comprising a vacuum pressure relief vent valve in communication with the ullage vapor space and configured to open while pressure of vapor within the ullage vapor space is below a predetermined minimum pressure, thereby to permit ingestion of air into the ullage vapor space, wherein return of the resilient wall member of the auxiliary vapor space toward the at-rest position in response to decreasing pressure within the auxiliary vapor space serves to reduce the volume of air ingested into the vapor space during normal operation.

12. The passive pressure control system of claim 7, wherein said auxiliary tank comprises a flexible bladder defining said resilient wall member.

13. The passive pressure control system of claim 12, wherein said bladder comprises a thin wall flexible urethane bladder.

14. The passive pressure control system of claim 12, wherein said bladder is disposed within a storage tank.

15. The passive pressure control system of claim 14, wherein said bladder is mounted about an inlet defined at an upper end of said storage tank.

16. The passive pressure control system of claim 12, wherein said auxiliary tank defines a tank air space of closed volume containing said bladder and said auxiliary tank further comprises an air relief/air ingestion valve in communication with said tank air space external of said bladder, said air relief/air ingestion valve being configured to open in response to a predetermined maximum pressure within said tank air space to permit flow of air from said tank air space and said air relief/air ingestion valve being configured to open in response to a predetermined minimum pressure within said tank air space to permit flow of air into said tank air space.

17. The passive pressure control system of claim 16, wherein pressure within said tank air space increases in response to increasing vapor pressure in said ullage vapor space and in said auxiliary vapor space.

18. The passive pressure control system of claim 16 or 17, wherein pressure within said tank air space decreases in response to decreasing vapor pressure in said ullage vapor space and in said auxiliary vapor space.

19. The passive pressure control system of claim 16, wherein the air relief portion of said air relief/air ingestion valve defines an orifice sized to limit flow rate of air from said tank air space, thereby to restrict depletion of auxiliary vapor spare capacity due to pressurization of said ullage vapor space.

20. The passive pressure control system of claim 19, said orifice of said air relief portion of said air relief/air ingestion valve is sized to limit flow of air from said tank air space to a rate of about 2.5 gallons (about 9.5 liters) per minute.

21. The passive pressure control system of claims 19 or 20, wherein the pressurization of said ullage vapor space and said auxiliary vapor space occurs during a faulty Stage I fuel drop.

22. The passive pressure control system of claim 16, wherein, for use with a balance-type vapor recovery system, said air relief portion of said air relief/air ingestion valve is set to near atmospheric pressure and said air ingestion portion of said air relief/air ingestion valve is set to near atmospheric pressure.

23. The passive pressure control system of claim 4, wherein said resilient wall member is a flexible wall member.

24. The passive pressure control system of claim 23, wherein said flexible wall member is defined by a flexible bladder.

25. The passive pressure control system of claim 7, wherein said resilient wall member is a flexible wall member.

26. The passive pressure control system of claim 25, wherein said flexible wall member is defined by a flexible bladder.

27. A passive pressure control system for controlling pressure in the ullage vapor space of a volatile liquid fuel underground storage tank ("UST") comprising means for temporarily, during periods of increasing ullage vapor space pressure, allowing vapor to flow from the ullage vapor flow into an auxiliary vapor space of variable volume.

* * * * *